US006433751B1

(12) United States Patent
Ishitobi et al.

(10) Patent No.: US 6,433,751 B1
(45) Date of Patent: Aug. 13, 2002

(54) LENS ANTENNA AND LENS ANTENNA ARRAY

(75) Inventors: Norimasa Ishitobi, Sakura; Hideaki Shimoda, Tokyo, both of (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/927,637

(22) Filed: Aug. 13, 2001

Related U.S. Application Data

(63) Continuation of application No. PCT/JP00/00667, filed on Feb. 8, 2000.

(30) Foreign Application Priority Data

Feb. 12, 1999 (JP) ..... 11-034216

(51) Int. Cl.[7] ..... H01Q 19/06
(52) U.S. Cl. ..... 343/753; 343/713
(58) Field of Search ..... 343/753, 754, 343/755, 711, 712, 713, 909, 911 R, 911 L

(56) References Cited

U.S. PATENT DOCUMENTS 3,255,454 A * 6/1966 Walter et al. ..... 343/754
4,224,626 A 9/1980 Sternberg ..... 343/911 R
4,847,628 A 7/1989 Sternberg ..... 343/754
5,264,859 A 11/1993 Lee et al. ..... 343/754
6,097,332 A * 8/2000 Crosby, II ..... 180/271
6,175,335 B1 * 1/2001 Ishikawa et al. ..... 343/704
6,195,058 B1 * 2/2001 Nakamura et al. ..... 343/753

FOREIGN PATENT DOCUMENTS

JP 51-100664 9/1976
JP 59-23483 6/1984

* cited by examiner

*Primary Examiner*—Tan Ho
(74) *Attorney, Agent, or Firm*—Oblon, Spivak, McClelland, Maier & Neustadt, P.C.

(57) ABSTRACT

The invention has for its object to achieve a high-performance lens antenna which can be integrated with the external (surface) shape of a mobile unit with no damage to the appearance of the mobile unit and is easy to manufacture and assemble at relatively low costs. To accomplish this, the invention provides a lens antenna mounted on a mobile unit, in which the radiation-side surface thereof and the focal-side surface thereof are each of a quasi-optical shape as a lens, and which is in a non-body of rotation form.

11 Claims, 5 Drawing Sheets

LENS ANTENNA AND LENS ANTENNA ARRAY

CROSS-REFERENCE TO RELATED APPLICATION

This application is a continuation of International Application No. PCT/JP00/00667 filed Feb. 8, 2000 and Japanese Application Nos. 11-34216 filed Feb. 12, 1999, and the entire content of both application is hereby incorporated by reference.

ART FIELD

The present invention relates to a lens antenna used with millimetric wave radar, etc. for mobile units such as vehicles.

BACKGROUND ART

Radar systems for mobile units such as vehicles, e.g., cars and motorcycles are now under extensive investigations for the purpose of automatic navigators, risk managements, etc. Among others, radar harnessing waves in the so-called millimetric wave range enables associated systems to be easily reduced in size and weight, and so is suitable for use on mobile units.

This radar system is generally broken down into a millimetric wave subsystem including oscillators, amplifiers, etc. and an antenna. Promising for this antenna is a lens antenna because it is relatively simple in structure and control of its directivity, etc. is achievable with relative ease.

The lens antenna itself has been investigated from various point-of-views as typically set forth in JP-A's 51-100664 and JP-B 59-23483.

A conventional lens antenna is generally made up of a body of rotation, as in optical glass, with one surface being of geometrical shape such as plane, sphere, hyperboloid, and paraboloid, and the other surface being of quasi-optically determined shape in consideration of the performance in demand, etc.

However, when the antenna in the form of a body of rotation is mounted on the surface of a mobile unit, there is no option but to locate the antenna on the center axis of the mobile unit so as to reduce damage to the external design thereof as much as possible. This is because most of mobile units are horizontally symmetric. Moreover, since the antenna formed on the body of rotation is also vertically symmetric, the vertically and horizontally symmetric portion of the surface of the associated mobile unit, especially an automobile is defined by a very limited portion, for instance, the leading portion of the center of a bumper, as shown at a position F in FIG. 8 as an example. In most cases, however, the geometrical radiation-side surface is in no coincidence with the surface shape that forms the surface of a bumper or the like of the mobile unit such as a vehicle. Thus, an element of an incompatible design located on the surface of the mobile unit is a chief factor for noticeable damage to the appearance thereof.

In particular, this poses a grave problem to a mobile unit such as an automobile in which design preferences are incorporated with importance attached to its appearance.

Further, when a mobile unit moving at high speed has a portion deformed slightly from the ideal configuration given by hydrokinetics, this portion becomes a factor for a lowering of the motion performance of the mobile unit due to large resistance occurring during high-speed movement. As is the case with a body structure excelling in aerodynamic properties, which is now intensively studied in the field of motorcars or motorcycles, therefore, the location of a structure that projects from or deforms the surface configuration of the mobile unit must be avoided as much as possible.

For an antenna capable of giving a free surface configuration conforming to the surface configuration forming the surface of a mobile unit, a conformal array antenna or the like is now under investigations, for instance, in the field of aviation equipments. However, the arrangement of a number of minute elements runs counter to cost reductions. In addition, the directivity performance obtained by control of a number of such elements is dynamically less than satisfactory.

Thus, to shelter this lens antenna with a resin radome is envisaged. However, the formation of the resin radome using a material having improved millimetric wave properties incurs an increase in the number of additional steps, which is a factor for further cost increases, and is unsuitable for general customer-oriented, mass-produced vehicles, and so on. Another possible approach is to house a lens antenna within a mobile unit as shown typically at a position I in FIG. 8, which lens antenna is a body of rotation and so does not square with the external shape of the mobile unit. However, reflections and attenuations due to the exterior materials of the mobile unit make it difficult to obtain the desired performance.

JP-A 08-139514 discloses a lens antenna integrated with a vehicle's bumper. In the structure shown in this publication, however, a convex lens antenna is formed on the back side of the bumper by means of integral molding or a plano-convex lens antenna is located on the back side of the bumper, as typically shown at a position H in FIG. 8, so that waves passing through the lens antenna portion can also propagate through the bumper. However, it is difficult to obtain a bumper body, for which low-cost material is required on the premise of recycling and which is exposed to mechanical stresses, and a lens antenna required to have a high degree of millimetric wave properties and a quasi-optical function as well as a shape with high dimensional accuracy, using the same material and integral molding.

For this reason, waves are affected by the quasi-optical refractive index given by the shape defined by the bumper portion and the lens antenna portion, and so it is difficult to obtain the desired performance. In addition, the location of the plano-convex lens on the back side of the bumper structurally gives rise to a junction or gap at which reflections or attenuations occur, resulting in a difficulty in obtaining the desired performance.

Yet possible approach is to use resin for a number plate and allow a part thereof to operate as an antenna, as shown at a position G in FIG. 8 and set forth in JP-A 07-283634. However, the replacement of number plates themselves is not realistic because of an enormous number of vehicles needing number place replacement and some considerable alternation of control of number plates themselves.

U.S. Pat. Nos. 4,224,626 and 4,847,628 disclose an aspherical lens antenna. However, although both publications show improvements in F-number, frequency properties and directivity, they teach nothing about the use of the lens antenna on a mobile unit and the compatibility of the lens antenna with the shape of the surface of an asymmetric mobile unit.

U.S. Pat. No. 5,264,859 discloses a lens antenna for radar used on mobile units. As in the aforesaid publications, this publication shows nothing about the compatibility of the lens antenna with the asymmetric configuration and the surfaces of mobile units.

DISCLOSURE OF THE INVENTION

An object of the present invention is to achieve a high-performance lens antenna which can be integrated with the external (surface) shape of a mobile unit with no damage to the appearance of the mobile unit, is easy to manufacture and assemble at relatively low costs as well as a lens antenna array comprising a plurality of such lens antennas.

The aforesaid object is achieved by the following embodiments.

(1) A lens antenna mounted on a mobile unit, which is in a non-body of rotation form, and in which, at a lens antenna-mounted position, the direction and magnitude of inclination and curvature of the surface of the mobile unit as well as the direction and magnitude of inclination and curvature of a radiation-side surface of the lens antenna are within ±20%, and a focal-side surface of the lens antenna is formed with respect to the radiation-side surface in such a way that the radiation-side surface and the focal-side surface have a quasi-optical configuration as a lens antenna.

(2) The lens antenna of (1), which is formed of a resin material or ceramics.

(3) The lens antenna of (1), wherein a constituting material thereof has a specific dielectric constant of $\in r=2$ to 12 in a frequency range used.

(4) The lens antenna of (1), wherein a focal length thereof is ⅓ to 3 times as large as a maximum length of an aperture projection surface thereof.

(5) The lens antenna of (1), wherein a junction of a surface of said mobile unit body and a surface of said lens antenna forms a continuous surface.

(6) The lens antenna of (1), wherein at least the radiation-side surface thereof is colored.

(7) The lens antenna of any one of (1) to (6), which is used in a frequency range of 30 to 300 GHz.

(8) The lens antenna of any one of (1) to (7), which has an antireflection film on the radiation-side surface thereof.

(9) The lens antenna of any one of (1) to (8), wherein the aperture projection surface thereof is of an elliptical shape.

(10) The lens antenna of any one of (1) to (8), wherein an auxiliary reflector, an auxiliary lens or a radio prism is located on a wave path between the lens antenna and a primary radiator.

(11) The lens antenna of any one of (1) to (10), wherein a plurality of lens antennas, each as recited in any one of (1) to (10), are integrally formed.

BEST MODE OF CARRYING OUT THE INVENTION

Mounted on a mobile unit, the lens antenna of the present invention has a non-body of rotation form. Configured in the form of a non-body of rotation, the lens antenna of the invention can be integrated with the external (surface) shape of the mobile unit with no damage to the appearance of the mobile unit, and can be easily manufactured at relatively low costs. The lens antenna of the invention can also be easily assembled while high performance is maintained intact.

With the lens antenna of the present invention, it is preferable that where on the mobile unit the lens antenna is to be mounted is first determined, and the configuration of the radiation-side surface of the lens antenna is then determined in conformity to the configuration of the surface of the position of the mobile unit body where the lens antenna is to be mounted.

Figure 1:
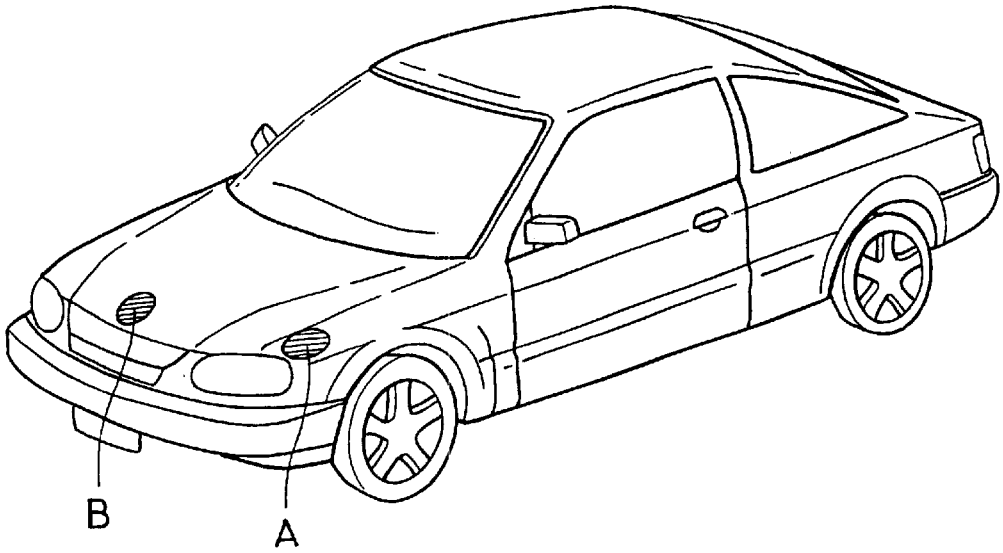
FIG. 1 is a perspective view of the appearance of a mobile unit, wherein the position where one lens antenna of the invention is mounted is illustrated.

FIG. 1 is a perspective view illustrative of a mobile unit, wherein one example of the position of the mobile unit, on which the lens antenna of the present invention is to be mounted, is shown.

Since the lens antenna of the present invention is a non-body of rotation, it is acceptable that the radiation surface thereof is axially asymmetric; it is vertically/horizontally asymmetric. For this reason, the lens antenna may be mounted not only at a vertically/horizontally symmetric position on the leading end of the mobile unit but also at any given position on the leading surface of the mobile unit in such a way that it is exposed to view, as shown at a position A in FIG. 1, with no damage to the external shape of the mobile unit.

For the lens antenna configured as mentioned above, it is preferable that the contour of its radiation surface is free from any area having a very small angle or radius of curvature.

The lens antenna of the present invention may also be axially symmetric. It follows that its radiation surface, too, is axially symmetric. Accordingly, the lens antenna may be mounted not only at a vertically symmetric position on the leading end of the mobile unit but also at any given center axial position on the leading surface of the mobile unit, as shown at a position B in FIG. 1, with no damage to the external shape of the mobile unit.

Figure 2:
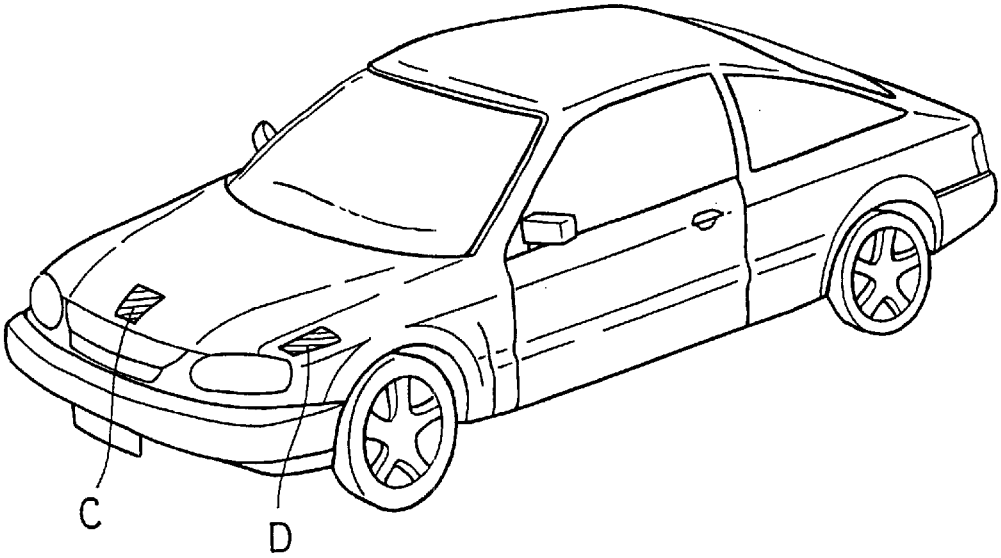
FIG. 2 is a perspective view of the appearance of a mobile unit, wherein the position where another lens antenna of the invention is mounted is illustrated.

Further, the lens antenna of the present invention may be configured such that its aperture projection surface is of either an elliptic shape or a triangular or rectangular shape containing a rounded angle. It is here noted that the term "aperture projection surface" used means a projection surface obtained by cutting a bundle of waves radiating from the focus of the lens antenna and transmitting through the lens antenna along a plane vertical thereto. By configuring the aperture projection surface in an elliptic form or a triangular or rectangular form containing a rounded angle, it is thus possible to locate the lens antenna at a position C or D in FIG. 2 with no damage to the external design of a mobile unit. Preferably in this case, the rounded portion should have a radius of R=1 to 100 mm, and especially R=about 5 to 20 mm.

For the lens antenna of the present invention, it is preferable that the junction of the surface of the mobile unit body and the surface of the lens antenna forms a continuous surface. When the junction of the surface of the mobile unit body and the surface of the lens antenna forms a continuous surface, there is neither damage to the external design of the mobile unit nor hydrokinetic resistance even during high-speed movement.

To allow that junction to keep continuity, at the position where the lens antenna is mounted, the direction and magnitude of inclination and curvature of the surface of the mobile unit should be in coincidence with the direction and magnitude of inclination and curvature of the radiation-side surface of the lens antenna. It is here noted that the term "coincidence" means that the direction and magnitude of inclination and curvature of the surface of the mobile unit as well as the direction and magnitude of inclination and curvature of the radiation-side surface of the lens antenna are within ±20%, and especially within ±5%.

The lens surface shape is not always limited to a sphere that can be expressed simply by curvature; it is understood that the lens surface may be of a more complicated shape such as one given by a two-variable function of higher order or a spline surface provided that it can be expressed in terms of sequences of function data in general-purpose higher-level languages such as FORTRAN, etc, as will be described later.

Furthermore, it is acceptable to color at least the radiation-side surface of the lens antenna of the present invention. By coloring the radiation-side surface, it is further possible to achieve color harmony with the mobile unit body and, hence, make damage to the external design thereof more unlikely.

With the lens antenna of the present invention as explained above, it is possible to determine where on the mobile unit the lens antenna is mounted as desired with no damage to the external design of the mobile unit, resulting in an increased degree of freedom in style and design.

Shape of the Aperture Projection Surface of the Lens Antenna

As mentioned above, the aperture projection surface of the lens antenna may be of an elliptic shape, a triangular or rectangular shape containing a rounded angle, or a round shape as well known in the art. However, the size of the aperture projection surface must be determined on the basis of the electrical radiant properties demanded for the lens antenna.

Here let $\theta$ be the radiant half-value breadth of the lens antenna, a be the maximum length of the aperture projection surface and $\lambda$ be wavelength. Then, the size of the antenna aperture projection surface has the relation $\theta=k\lambda/a$, where k is assumed to be of the order of 1 to 1.5 (see "Antenna Engineering Handbook", TEMA, Ohm, S55, 10, 30).

For instance, if the necessary radiant half-value breadth $\theta$ is 3 degrees or $3/180\times\pi=0.05$ radians, the frequency is 60 GHz or wavelength $\lambda=3\times10^8/60\times10^9=5\times10^{-3}$ meters and k=1, then $a=k\lambda/\theta=5\times10^{-3}/0.05=0.1$ meter.

It is to be understood that the necessary radiant half-value breadth often varies depending on whether in the horizontal direction or in the vertical direction, and so the aperture projection surface may be configured in a form other than round form in consideration of compatibility with the external design of the mobile unit. Only the requirement for this case is to satisfy the size of the aperture projection surface determined depending on the radiant half-value breadth in each direction.

Focal Position of the Lens Antenna

The focal position of the lens antenna is defined by a distance from the focal-side surface thereof. In the present invention, the focal position is located at a distance preferably ⅓ to 3 times, more preferably ½ to 2 times, and even more preferably ⅔ to 3/2 times as large as the size a of the aperture projection surface.

When the focal position is near to the lens, the depth of an antenna system including a primary radiator may be reduced. However, not only does the thickness of the lens antenna increase with the result that material cost increases, but also a displacement of the position for mounting the primary radiator gives rise to large performance variations. Especially when the lens antenna material has a large dielectric constant, there are detriments such as a radiant efficient drop.

When the focal position of the lens antenna is far away from the lens, on the other hand, the lens antenna becomes thin. Although there are advantages such as decreases in performance variations due to the position for mounting the primary radiator and increased radiant efficiency, there is an increased demand for the primary radiator to have sharp directivity because of an increase in the depth of the antenna system including the primary radiator. This often leads to another need for the provision of an additional quasi-optical system such as an auxiliary reflector, an auxiliary lens and a prism, thereby achieving a further depth reduction and giving sharp directivity to the primary radiator system.

Material for the Lens Antenna

For the material constituting the lens antenna, various materials may be used, including Teflon having improved high-frequency properties, an open-celled, porous crystalline polymer material as set forth in JP-A 59-23483, a heat-resistance, low-dielectric polymer material as set forth in JP-A 09-246052, a ceramic material or a composite material thereof. Of these materials, preference is given to resin materials because they are lightweight, and easy to mold and process. For instance, when the lens antenna is required to have some hardness and strength, however, it is preferable to make an appropriate selection from ceramic materials such as alumina depending on the conditions under which it is used and what purpose it is used for.

The constituting material should preferably have a specific dielectric constant of $\in r=2$ to 12, and especially $\in r$=about 5 to 9 at the frequency at which the lens antenna is used. A material having too low a specific dielectric constant makes a lens antenna too thick, resulting in weight increases, and the use of an expensive material incurs some considerable costs. When an antireflection film is provided for the purpose of reducing surface reflections, the specific dielectric constant of a material selected for the antireflection film must be equal to the square root of the specific dielectric constant of the lens body. Therefore, if the dielectric constant $\in r$ of the lens body, for instance, is 2, then the specific dielectric constant of the surface antireflection film fit therefor is 1.41. However, materials having specific dielectric constants less than 2 are only available with difficulty. In addition, most of these materials having very low specific dielectric constants are not preferable for exposure on the surface of the mobile unit because they are fragile.

With a material having too high a specific dielectric constant, on the other hand, the thickness and weight of an antenna may be reduced; however, the provision of an antireflection film is essentially required because of increased reflections. Still, the provision of the antireflection film causes the antenna to have extreme frequency properties because the frequency range, for which the antireflection film is effective, is narrow.

How to provide the antireflection film on the (radiating) surface of the lens antenna is typically disclosed in JP-A's 07-16941, 07-16862 and 07-30324.

Focal-Side Surface Shape of the Lens Antenna

To form the lens antenna body in such a way that the surface forming the radiating surface thereof and the focal-side surface have a quasi-optical configuration enough to function as a lens antenna in the frequency range used, a variety of quasi-optical designing methods may be used. Among others, it is preferable to use an optical simulation program.

This optical simulation program is commercially available in the form of optical design and estimation programs, etc. A simulation analysis for a lens may be carried out by loading such an optical simulation program into a general-purpose personal computer (a class of personal computer with a built-in Pentium microprocessor) or a workstation, etc. Any given shape of the lens surface, too, may be easily simulated on condition that the shape can be expressed in higher-level languages such as C and FORTRAN with mathematical expressions (functions), data sequences, etc. Methods for capturing the given shape in the personal computer, etc. to simulate the same with mathematical expressions (functions) and data sequences include a method using the data (CAD data, etc.) on the given shape at the design stage as well as a method wherein data on an actual shape are captured in the personal computer using a 3D measuring device such as a laser analyzer (a shape measuring device relying on laser interference), and a mathematical method such as a method of least squares is applied on the captured data to find a coefficient for a surface-defining equation and formulate a mathematical expression of the same.

After the shape of the lens radiating surface is determined in such a way as to conform to the shape of the surface of the mobile unit, the shape and thickness of the focal-side surface is determined using such a simulation program as mentioned above.

The optical simulation programs usable herein, for instance, include CODE V made by Optical Research Associates Co., Ltd., U.S.A.

Most of these optical simulation programs for analyses on the basis of geometric optics are susceptible to large errors when used for the design of lens antennas. For instance, care should be taken of the fact that radiant efficiency drops in the case where focal lengths are very short, radiant efficiency drops due to the directivity of primary radiators, etc. are often undetected through analyses based on geometric optics. However, any fatal error was not found in the numerical range defined according to the present invention.

Figure 6:
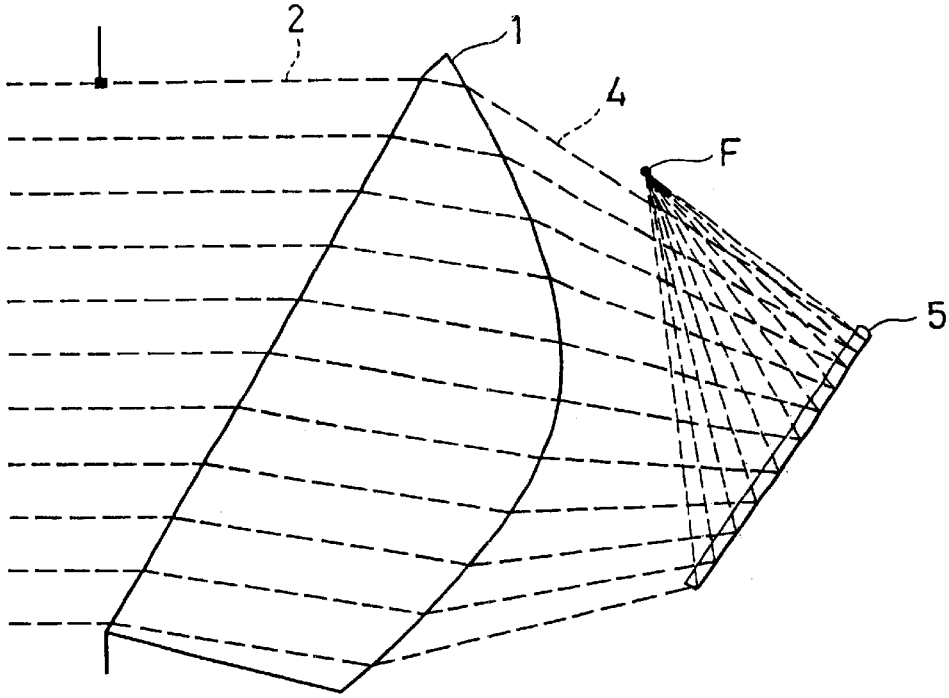
FIG. 6 is a sectional view illustrative of wave propagation paths in a further experimental example of the lens antenna of the invention, wherein an auxiliary reflector is located on the focal side thereof.
Figure 7:
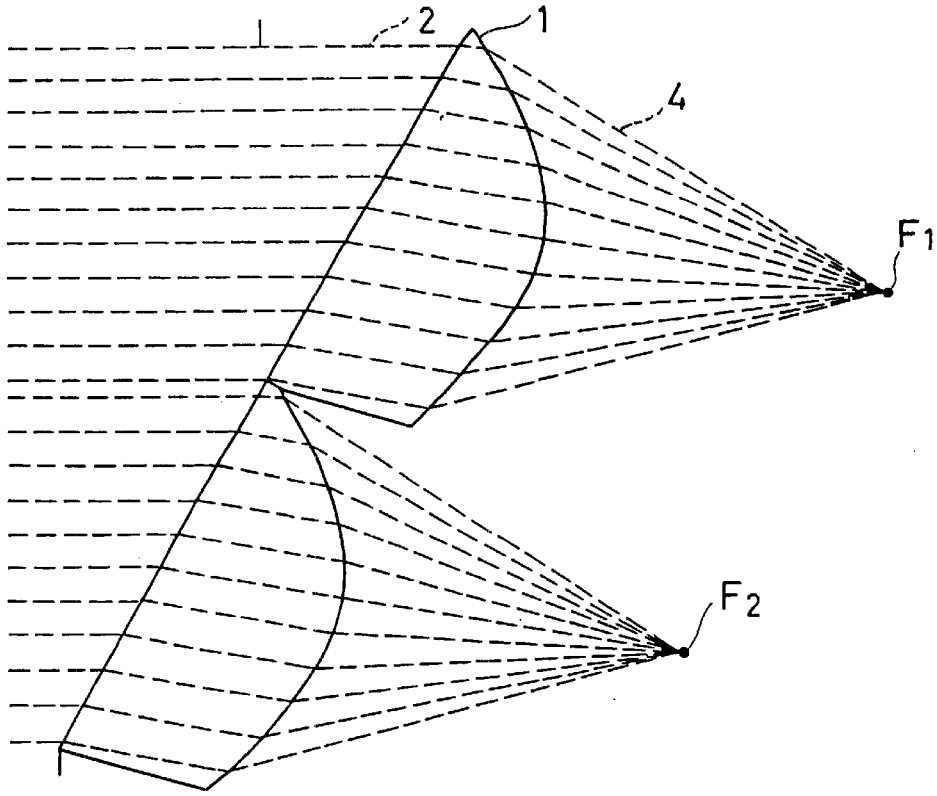
FIG. 7 is a sectional view illustrative of wave propagation paths in the case where a plurality of lens antennas, each according to an experimental example of the invention, are assembled in the form of an antenna array.
Figure 8:
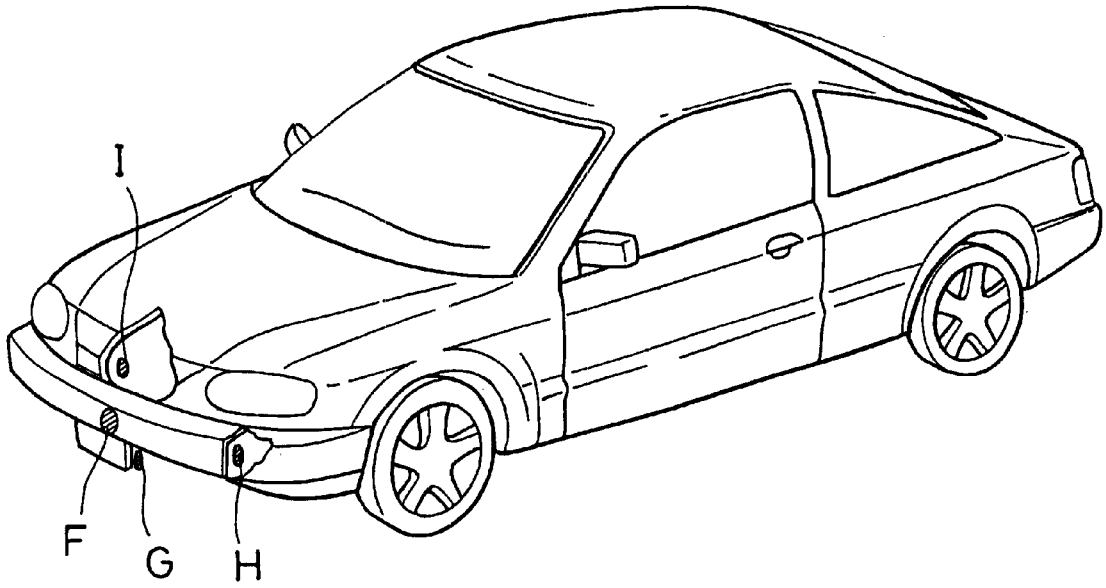
FIG. 8 PRIOR ART
FIG. 8 is a perspective view illustrative of the appearance of a mobile unit, wherein the position where a conventional lens antenna is mounted is illustrated.

Shifting of the Focal Position Due to Auxiliary Reflector, Auxiliary Lens and Prism When the focal position is far away from the focal-side surface of the lens antenna as explained with reference to the focal position, there is an increase in the depth of an antenna system including a primary radiator, which often makes it difficult to mount the antenna system on a mobile unit. If, in this case, such an auxiliary reflector or auxiliary lens or a radio prism as shown in FIG. 6 is located on wave paths between the lens antenna and the primary radiator, it is then possible from the focal surface of the lens antenna, and the dielectric constant of a lens material was 2.1. These conditions were given to the aforesaid simulation program (CODE V, Optical Research Associates Co., Ltd.) to find the shape of the focal-side surface of the lens antenna. In the aforesaid optical simulation, care should be taken of the fact that the square root of a dielectric constant must be given as the index of refraction. In the instant experimental example, the dielectric constant is 2.1 and so the index of refraction given to a simulator was 1.449.

In the instant experimental example, the lens antenna was mounted on the leading end of the hood at the center of a car body, as shown at B in FIG. 1. In this case, the radiation-side surface of the lens antenna was inclined with respect to the focal side upwardly from below, and the magnitude of inclination of the radiation-side surface was 60 degrees with respect to the radiating direction. The curvature of the radiation-side surface was infinity; the radiation-side surface was of a planar shape.

In the instant experimental example, it is noted that the direction and magnitude of inclination and curvature of the radiation-side surface of the lens antenna are not necessarily in coincidence with those of the position on the surface of the mobile unit, on which the lens antenna is mounted. However, this is believed to be enough to explain the embodiment of the present invention.

Figure 3:
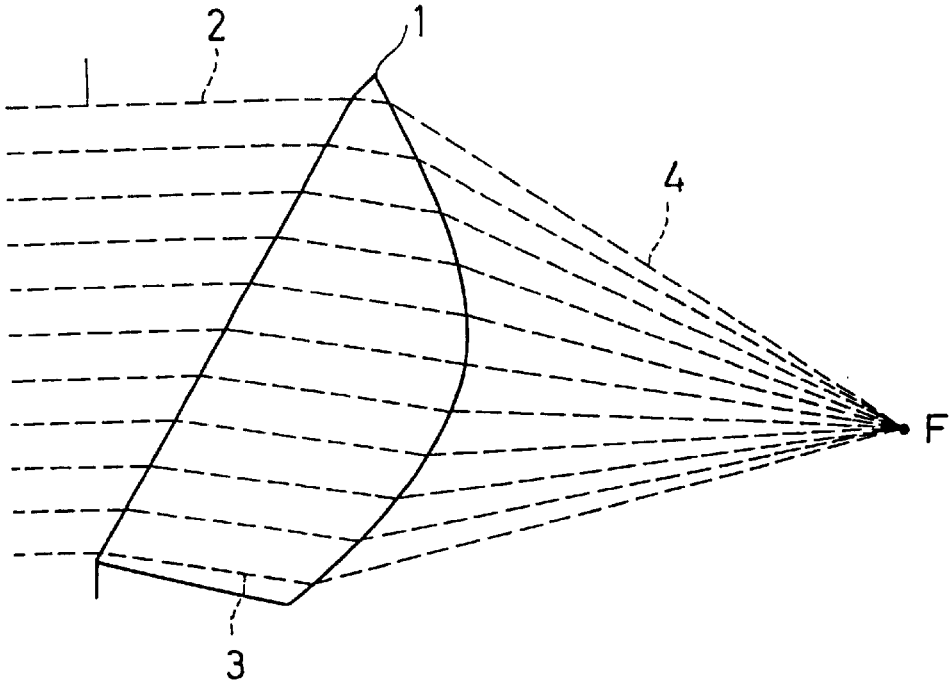
FIG. 3 is a sectional view of one experimental example of the lens antenna of the invention, wherein wave propagation paths therefor are shown.
Figure 4:
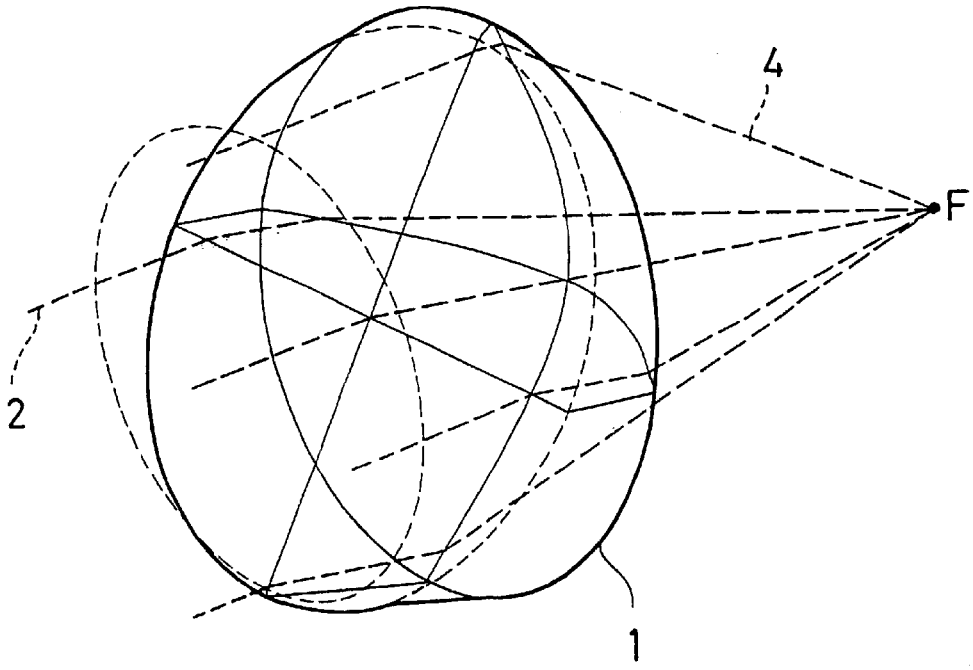
FIG. 4 is illustrative of the structure of the experimental example of the lens antenna of the invention, as viewed obliquely from below on the focal side thereof.

FIG. 3 is a sectional view illustrative of the lens antenna designed according to the instant experimental example and wave propagation paths therefor. Referring to FIG. 3, as incident waves 2 enter a lens antenna 1, their paths are altered (3) to give waves 4 converging to a focus F. FIG. 4 is a perspective view illustrative of the structure of the lens antenna 1 of the instant experimental example, as viewed obliquely from below on the focal side, wherein propagation paths for waves 2 and 4, the horizontal and vertical sections of the lens antenna and the shape of an aperture projection surface are shown.

In the instant experimental example, the lens antenna is of a horizontally symmetric (axially symmetric) shape. However, even when the lens antenna is mounted off the center axis of the mobile unit, a similar design method may be applied while the radiation-side surface of the lens antenna is inclined from horizontal in such a way as to conform to the surface shape of the mobile unit. In the instant experimental example, the radiation-side surface of the lens antenna is of a planar shape. However, if a similar design method is applied at a curvature preset in such a way as to conform to the surface shape of the mobile unit, it is then possible to construct a lens antenna more compatible with the external shape of the mobile unit.

Figure 5:
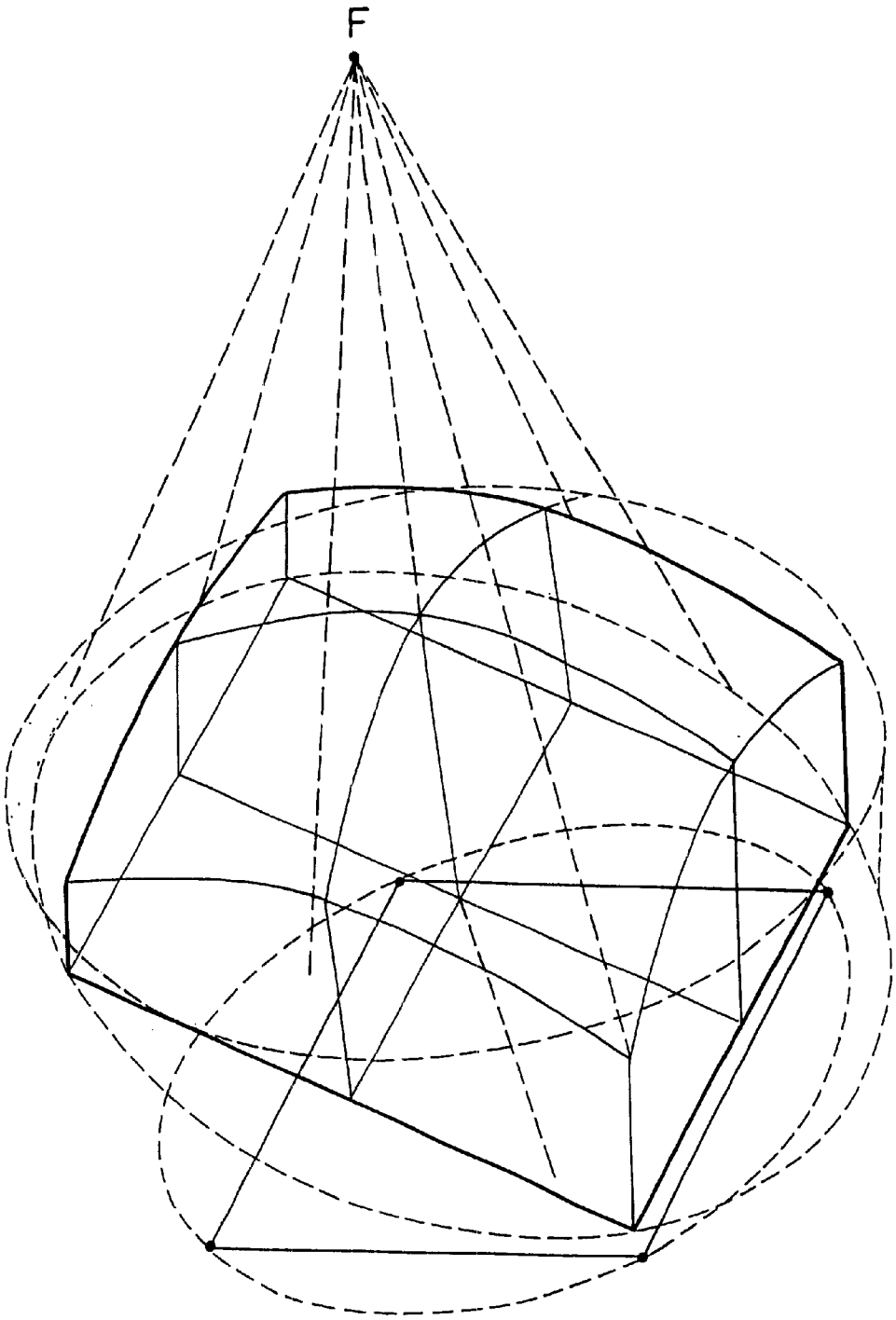
FIG. 5 is illustrative of the structure of another experimental example of the lens antenna of the invention, wherein the aperture surface thereof is of a rectangular shape.

In the instant experimental example, the aperture projection surface of the lens antenna is of a round shape. However, if the aperture projection surface is of size enough to satisfy the necessary radiant half-value breadth, it is then possible to cut the lens antenna to any given shape, thereby constructing a lens antenna more compatible with the external shape of the mobile unit. For instance, FIG. 5 is illustrative of the case where the upper and lower, and right and left portions of the lens antenna according to the instant experimental example are cut off to change the shape of the aperture projection surface to a rectangular shape. In this case, the radiant half-value breadth in both the horizontal and vertical directions is determined by the maximum aperture size of the lens antenna in the horizontal and vertical directions; care should be taken of the fact that the radiant half-value breadth is larger than that before cutting. Although not shown in FIG. 5, it is noted that chamfering of the sections and rounding of the angles give rise to a mechanical strength increase with the result that the quality of the external shape, and especially the design of the mobile unit, is improved.

If the at least the radiation-side surface of the lens antenna according to the instant experimental example is colored, it is then possible to construct a lens antenna more compatible with the external shape of the mobile unit.

ADVANTAGES OF THE INVENTION

According to the present invention as described above, it is possible to achieve a high-performance lens antenna which can be integrated with the external (surface) shape of a mobile unit with no damage to the appearance of the mobile unit and is easy to manufacture and assemble at relatively low costs as well as a lens antenna array comprising a plurality of such lens antennas.

What is claimed is:

1. A lens antenna mounted on a mobile unit, which is in a non-body of rotation form, in which, at a lens antenna-mounted position, the direction and magnitude of inclination and curvature of the surface of the mobile unit as well as the direction and magnitude of inclination and curvature of a radiation-side surface of the lens antenna are within +20%, and wherein a focal-side surface of the lens antenna is formed with respect to the radiation-side surface in such a way that the radiation-side surface and the focal-side surface have a quasi-optical configuration as the lens antenna.

2. The lens antenna of claim 1, which is formed of a resin material or ceramics.

3. The lens antenna of claim 1, wherein a constituting material thereof has a specific dielectric constant of $\in r=2$ to 12 in a frequency range used.

4. The lens antenna of claim 1, wherein a focal length thereof is ⅓ to 3 times as large as a maximum length of an aperture projection surface thereof.

5. The lens antenna of claim 1, wherein a junction of a surface of said mobile unit body and a surface of said lens antenna forms a continuous surface.

6. The lens antenna of claim 1, wherein at least the radiation-side surface thereof is colored.

7. The lens antenna of any one of claims 1 to 6, which is used in a frequency range of 30 to 300 GHz.

8. The lens antenna of claim 1, which has an antireflection film on the radiation-side surface thereof.

9. The lens antenna of claim 1, wherein the aperture projection surface thereof is of an elliptical shape.

10. The lens antenna of claim 1, wherein an auxiliary reflector, an auxiliary lens or a radio prism is located on a wave path between the lens antenna and a primary radiator.

11. The lens antenna of claim 1, wherein a plurality of lens antennas, each as recited in claim 1, are integrally formed.

* * * * *